US009635935B2

(12) United States Patent
Guridi

(10) Patent No.: US 9,635,935 B2
(45) Date of Patent: May 2, 2017

(54) GAME TABLE FOR EXERCISE AND RECREATION

(71) Applicant: Jose Javier Silva Guridi, Spring, TX (US)

(72) Inventor: Jose Javier Silva Guridi, Spring, TX (US)

(73) Assignee: First In Recreation & Entertainment, Inc., Spring, TX (US)

( * ) Notice: Subject to any disclaimer, the term of this patent is extended or adjusted under 35 U.S.C. 154(b) by 53 days.

(21) Appl. No.: 14/737,654

(22) Filed: Jun. 12, 2015

(65) Prior Publication Data

US 2016/0058178 A1 Mar. 3, 2016

Related U.S. Application Data

(60) Provisional application No. 62/041,892, filed on Aug. 26, 2014.

(51) Int. Cl.

| | |
|---|---|
| ***A63F 7/00*** | (2006.01) |
| ***A47B 25/00*** | (2006.01) |
| *A63F 7/06* | (2006.01) |

(52) U.S. Cl.

CPC ..... *A47B 25/00* (2013.01); *A63F 7/00* (2013.01); *A63F 7/06* (2013.01); *A63F 7/0632* (2013.01)

(58) Field of Classification Search

CPC ..... A47B 25/00; A63F 7/0005; A63F 7/00; A63F 7/06; A63F 7/0616; A63F 7/062; A63F 7/0632; A63F 7/0636

USPC ..... 273/108–129 W

See application file for complete search history.

(56) References Cited

U.S. PATENT DOCUMENTS

| | | | | | |
|---|---|---|---|---|---|
| 3,912,269 | A * | 10/1975 | Barlow | A63F 7/0684 | 273/108.51 |
| 4,480,833 | A * | 11/1984 | Barcelow | A63F 7/0684 | 273/108.56 |
| 5,046,734 | A * | 9/1991 | Laine | A63F 7/0684 | 273/108.51 |
| 5,222,735 | A * | 6/1993 | Savage | A63F 7/0684 | 273/108.53 |
| 5,884,911 | A | 3/1999 | Guridi | | |
| RE37,451 | E | 11/2001 | Guridi | | |
| D476,697 | S | 7/2003 | Guridi | | |
| 8,016,288 | B1 | 9/2011 | Guridi | | |

* cited by examiner

*Primary Examiner* — Sebastiano Passaniti

(74) *Attorney, Agent, or Firm* — Lightbulb IP, LLC

(57) ABSTRACT

A game table for exercise and recreation provides an engaging game for players wherein a ball or other game piece may be advanced to score goals or points. The game table includes an angled playing surface to which a pair of paddle assemblies may be movably secured via corresponding slots in the playing surface. Typically, the slots will be at the ends of the playing surface and extend laterally. A pair of goal box assemblies provide a scoring opportunity for players and are located at the ends of the playing surface. Side openings may be formed in the walls of the game table to allow improved range of motion, including rotationally, of the paddle assemblies.

13 Claims, 5 Drawing Sheets

FIG. 1C
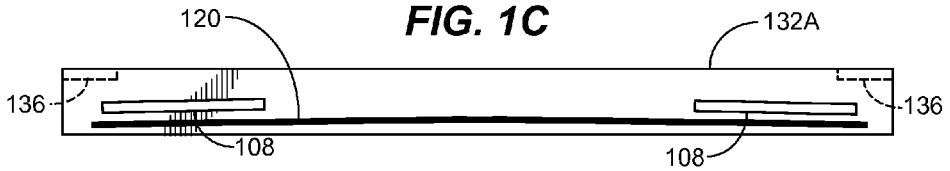
FIG. 1D
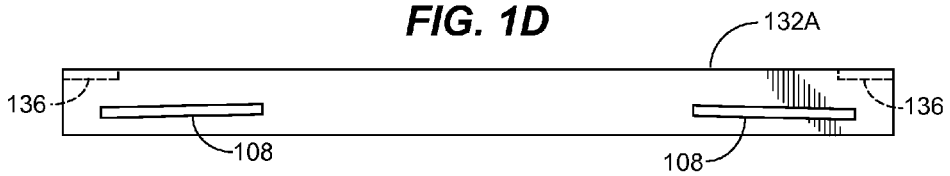
FIG. 2A
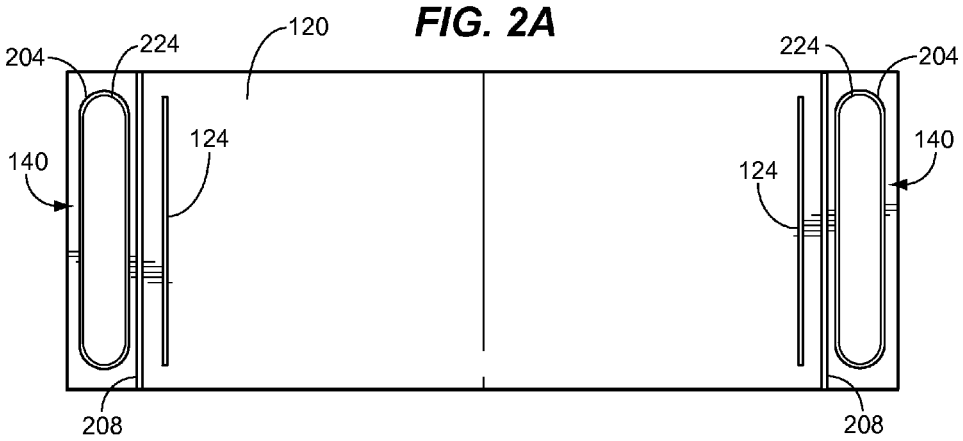
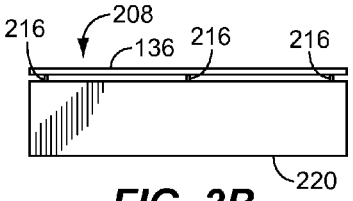
FIG. 2B
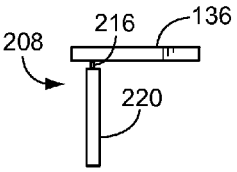
FIG. 2C

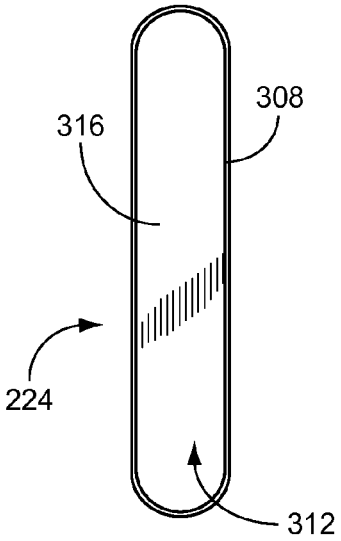
FIG. 3A
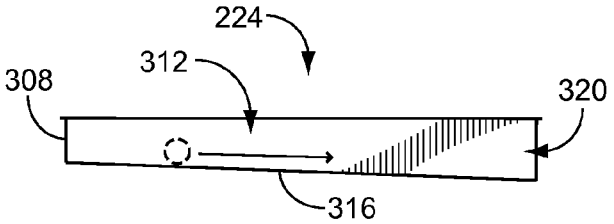
FIG. 3B
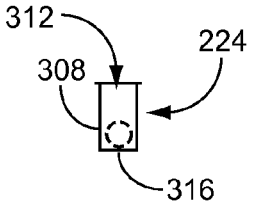
FIG. 3C
FIG. 3D
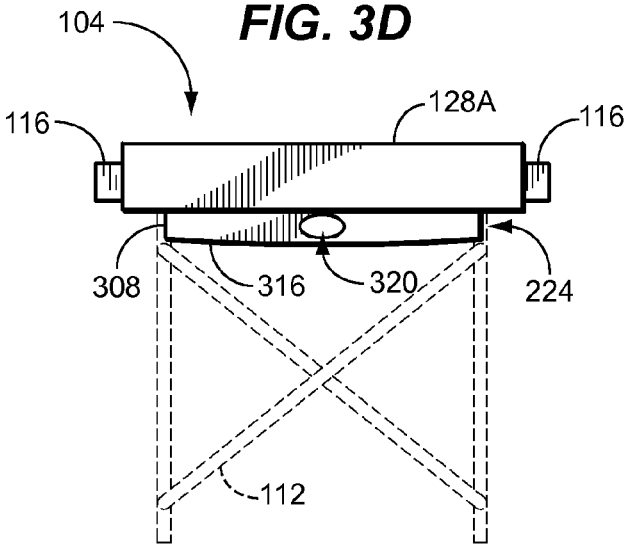

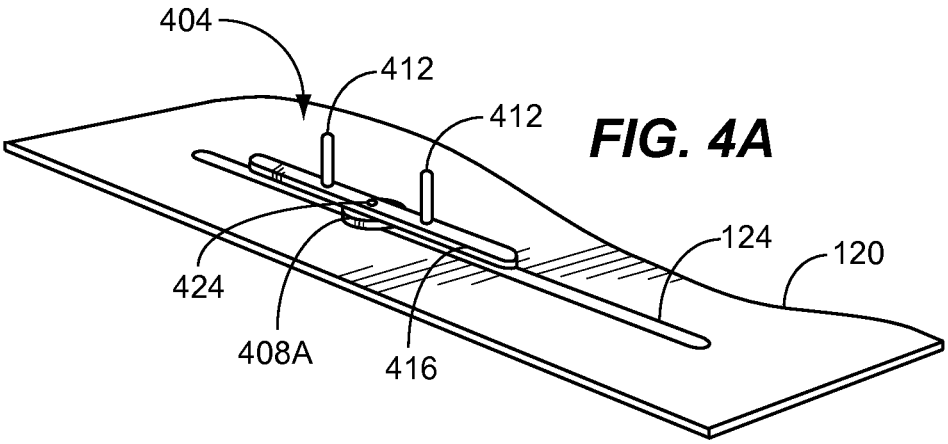
FIG. 4A
FIG. 4B
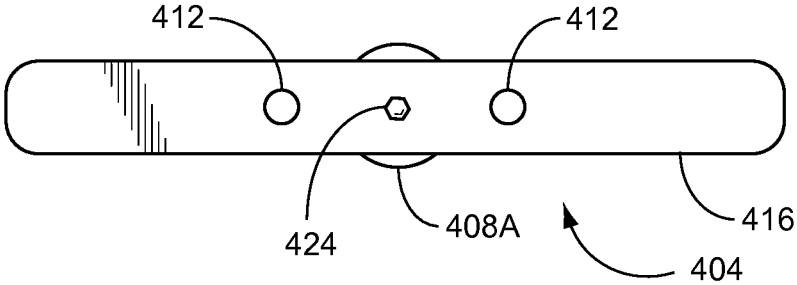
FIG. 4C
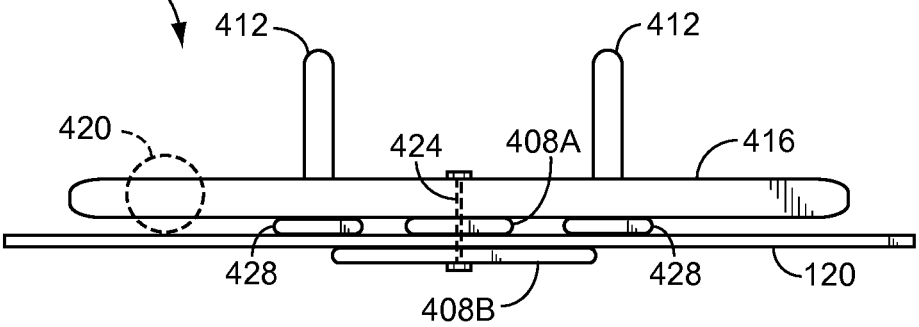

GAME TABLE FOR EXERCISE AND RECREATION

CROSS-REFERENCE TO RELATED APPLICATION

This application claims priority to U.S. Provisional Patent Application No. 62/041,892, filed Aug. 26, 2014.

BACKGROUND OF THE INVENTION

Field of the Invention

The invention relates to sports, recreational, game room and other table games and in particular to a game table providing exercise and recreation to its players.

Related Art

A wide variety of table games exist. Some examples of traditional table games include pool, foosball, air hockey, and table tennis. Players generally manipulate equipment, such as paddles or mallets, to influence a game piece during game play. This equipment may be freely swung or otherwise moved by players, or may be limited in its degree of freedom of motion.

From the discussion that follows, it will become apparent that the present invention addresses the deficiencies associated with the prior art while providing numerous additional advantages and benefits not contemplated or possible with prior art constructions.

SUMMARY OF THE INVENTION

A game table for exercise and recreation is disclosed herein. The game table provides movably secured paddle assemblies that can be used to score and prevent scoring. Resistance to the lateral motion and rotation of the paddle assemblies can be increased to require increased physical exertion during game play. Likewise, such resistance can be lowered to lower physical exertion. In addition, the game table may include goal box assemblies that require a particular minimum amount of force before a goal or point can be scored. The challenge and physicality provided by the game played at the game table provides recreation as well as exercise for its players.

Various game tables and methods related thereto are disclosed herein. In one exemplary embodiment for example, the game table comprises a playing surface having a first end and a second end and two sides, one or more first slots in the playing surface extending laterally between the two sides at the first end, a first paddle assembly at a top side of the first slots and comprising a blade and one or more handles, and one or more first pads at a bottom side of the first slots. The first paddle assembly is movably secured to the playing surface via one or more fasteners extending from the first paddle assembly to the first pads through the first slots.

The game table also comprises one or more second slots in the playing surface extending laterally between the two sides at the second end, a second paddle assembly at a top side of the second slots and comprising a blade and one or more handles, and one or more second pads at a bottom side of the second slots. The second paddle assembly is movably secured to the playing surface via one or more fasteners extending from the second paddle assembly to the second pads through the second slots.

A first goal box is at the first end of the playing surface, and a second goal box is at the second end of the playing surface. In addition, one or more resilient cords may be at a bottom side of the playing surface such that a portion of the first pads, the second pads or both engage the resilient cords. A pair of end blocks may be at a bottom side of the playing surface to restrict movement of a paddle assembly.

Also, one or more guide blocks may be at a bottom side of the playing surface and extend parallel to the first slots, the second slots or both to guide movement of a paddle assembly. A movable fence may be at an opening of the first goal box, the second goal box or both. A cover may be provided to enclose the playing surface, and the playing surface may be sloped.

In another exemplary embodiment, a game table is disclosed that comprises a playing surface comprising a top side and a bottom side, one or more first slots in the playing surface, and one or more second slots in the playing surface. A first paddle is at a top side of the first slots and one or more first pads at a bottom side of the first slots, with one or more fasteners extending from the first paddle to the first pads through the first slots to secure the first paddle to the playing surface.

Similarly, a second paddle is at a top side of the second slots and one or more second pads at a bottom side of the second slots, with one or more fasteners extending from the second paddle to the second pads through the second slots to secure the second paddle. One or more first resilient cords are at the bottom side of the playing surface that engage the first pads, and one or more second resilient cords are at the bottom side of the playing surface that engage the second pads.

A first goal box may be at a first end of the playing surface and a second goal box may be at a second end of the playing surface, or both. One or more engagement blocks that engage the first resilient cords may be attached to the first pads. Likewise, one or more engagement blocks that engage the second resilient cords may be attached to the second pads.

A pair of end blocks may be at a bottom side of the playing surface to restrict movement of a paddle. One or more guide blocks may be at a bottom side of the playing surface and extend parallel to the first slots, the second slots or both to guide movement of a paddle. A cover may be provided to enclose the playing surface.

As stated, various methods are disclosed herein as well. For instance, in one exemplary method, a method of exercise and recreation with a game table is disclosed, with such method comprising engaging a paddle at a top side of a playing surface of the game table via one or more handles, and moving the paddle along one or more slots in the playing surface, engaging one or more resilient cords with the pads when moving the paddle along the slots, and rotating the paddle via the handles. The paddle is secured by one or more fasteners which extend through the slots from the paddle to one or more pads at a bottom side of the slots.

The method may also include striking a game piece into a goal box at the top side of the playing surface with the paddle. It is noted that the goal box may comprise a fence that moves when the game piece strikes the fence. Movement of the paddle may be guided by one or more guide blocks at a bottom side of the playing surface. Alternatively or in addition, movement of the paddle may be restricted by one or more end blocks at a bottom side of the playing surface. In addition, the method may include covering the playing surface with a cover.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 1C is a cross sectional side view of an exemplary game table;

FIG. 1D is a side view of an exemplary game table;

FIG. 2A is top view of an exemplary playing surface and goal box assemblies;

FIG. 2B is a front view of an exemplary gate;

FIG. 2C is a side view of an exemplary gate;

FIG. 3A is a top view of an exemplary ball return;

FIG. 3B is a side view of an exemplary ball return;

FIG. 3C is a front view of an exemplary ball return;

FIG. 3D is a side view of an exemplary ball return;

FIG. 4A is a perspective view of an exemplary paddle assembly;

FIG. 4B is a top view of an exemplary paddle assembly;

FIG. 4C is a side view of an exemplary paddle assembly;

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1A:
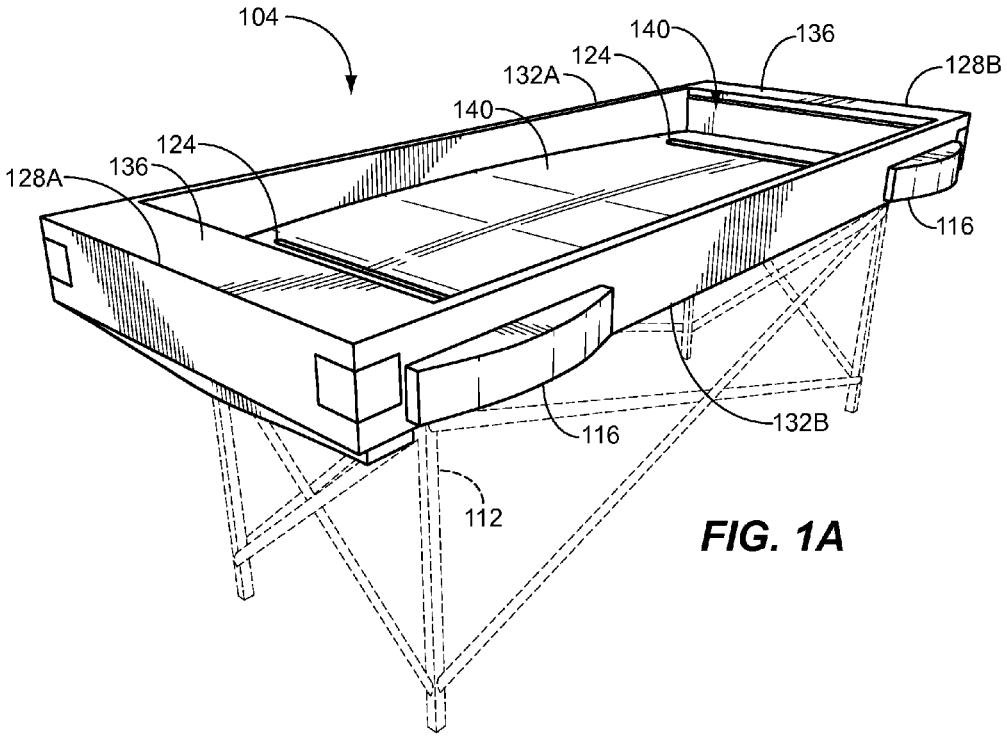
FIG. 1A is a perspective view of an exemplary game table.
Figure 1B:
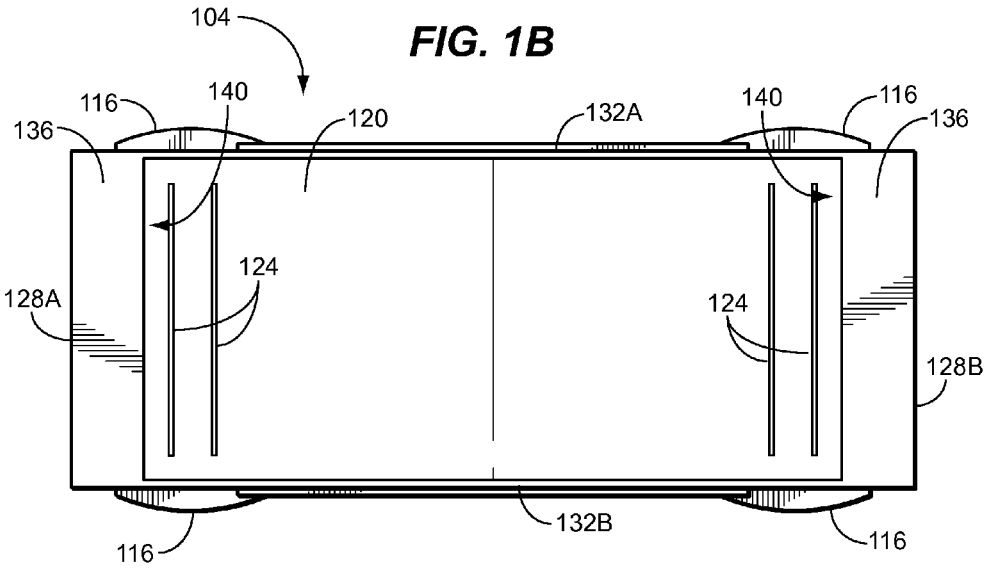
FIG. 1B is a top view of an exemplary game table.

In general, the game table herein facilitates play of a game for recreation and exercise in which players advance a ball, puck or other game piece to score points or goals. As shown in FIGS. 1A-1B, the game table 104 comprises a playing surface 120 upon which players advance a game piece to score points or goals. The playing surface 120 will typically be sloped or angled. As can be seen from FIG. 1A for example, the playing surface 120 slopes downward from its raised central portion as it extends towards a first end 128A and second end 128B of the game table 104. FIG. 1C illustrates a cross-sectional view of the same. The playing surface 120 will typically be planar and configured to support the game piece.

It is contemplated that the playing surface 120 may be angled or sloped in other ways, or not at all. For example, the playing surface 120 may be raised at the first end 128A and second end 128B of the game table 104 with a depressed portion at its center. Alternatively, the playing surface 120 may be horizontal between the first end 128A and the second end 128B.

The playing surface 120 will typically comprise one or more slots 124. As shown for example, the playing surface 120 comprises four slots 124 extending laterally between the first and second side walls 132A, 132B of the game table 104. Also, as can be seen, the slots 124 are at the distal ends of the playing surface 120, near the first and second ends 128A, 128B of the game table. As will be discussed further below, a slot 124 will typically accept and guide a paddle assembly along its length during game play. A single slot 124 may be used for a single paddle assembly. Alternatively, multiple slots 124 may guide a single paddle assembly, such as for added stability, durability or both.

Typically, the playing surface 120 will be surrounded at its periphery. As shown in FIGS. 1A-1B for example, the playing surface 120 is bordered by the first and second ends 128A, 128B as well as a first side wall 132A and a second side wall 132B. As can be seen, these elements may be planar or straight. During game play, the first and second ends 128A, 128B and the first and second sides 132A, 132B help ensure that a game piece remains on the playing surface 120. As will be described further below, a goal assembly 140 will be located at the first and second ends 128A, 128B.

The game table 104 may be elevated by one or more supports such as legs 112. This positions the game table 104 at a raised position for game play. In this manner, players may play while standing. It is noted that the legs 112 may be various heights to allow for various postures during game play.

Referring to FIG. 1D, it can be seen that one or more side openings 108 may be formed in the first side 132A, the second side 132B or both. During game play, a paddle assembly may be moved along its respective slot 124 or slots. A side opening 108 allows a paddle assembly to extend out of the first or second side 132A, 132B. This increases the lateral range of motion of the paddle assembly, since the paddle assembly can pass through the first or second side 132A, 132B rather than being blocked by it.

Referring back to FIGS. 1A-1B, one or more paddle wells 116 may be included as well. As can be seen, one or more paddle wells 116 may be attached to the first side 132A, the second side 132B or both. A paddle well 116 will typically be positioned near the end of a slot 124, and to cover the side openings 108 of the game table 104. This allows a paddle well 116 to protect players from contact with a paddle assembly when the paddle assembly is moved laterally to either side of the game table 104, such as during game play.

Various goal box assemblies 140 will now be described with regard to FIGS. 2A-2C. Referring to FIG. 2A, which illustrates a top view of a goal box assembly 140 with its top cover 136 removed, it can be seen that a goal box assembly 140 may comprise a cutout 204 in the playing surface to receive a ball (or other playing piece) that enters the goal box assembly 140. The cutout 204 will typically extend through the playing surface 120 to allow a ball to drop through the playing surface 120 after a goal is scored.

The cutout 204 may extend laterally between the sides 132A, 132B of the game table 104, such as shown. This helps ensure that a ball that enters the goal box assembly 140 is subsequently received by the cutout 204. Thereafter, the ball can be returned to a player, such as by entering a ball return 224 as will be described further below. It is noted that one or more walls or guide structures may be provided to reflect or otherwise guide a ball into the cutout 204 in some embodiments. For example, the cutout 204 may have walls at or around its periphery to guide a ball into the cutout.

FIG. 2A also shows a gate 208 of an exemplary goal box assembly 140. In general, a gate 208 is a structure that a ball (or other game piece) must pass through in order to enter the goal box assembly 140. In one or more embodiments, a goal or point may only be scored if a ball is advanced beyond the gate 208. The gate 208 may be configured to provide various levels of resistance to the motion of a ball, such as to ensure a player advances the ball with sufficient force. This encourages players of the table game to exert force and exercise their muscles. While one player seeks to advance a ball to score with his or her paddle assembly, an opposing player can utilize his or her paddle assembly to block the ball from entering his or her goal box assembly 140.

FIGS. 2B-2C respectively illustrate a front and side view of an exemplary gate 208. As can be seen, the gate 208 may comprise a fence 220 that is movably mounted. In FIGS. 2B-2C, the fence 220 is hung via one or more mounts 216 from the top cover 136 of the goal box assembly 140. As can be seen, a ball that strikes the fence 220 would have to do so with sufficient force to move the fence before the ball can enter the goal box assembly 104 and before a goal can be scored.

It is noted that a fence 220 may be mounted in various ways. For example, a fence may be mounted via one or more hinges, pivots or the like to the top cover 136 or the playing surface 120. It is contemplated that a fence 220 may have a biasing mechanism in one or more embodiments. For example, one or more springs, elastic bands or the like may be used to bias the fence 220 (i.e., to hold the fence 220 in position until sufficient force is exerted to move the fence). Typically, such a spring or band would be attached to the fence 220 at one end and to a fixed portion of the game table 140 at another end, such as the top cover 136 or playing surface of the game table.

As disclosed above, one a ball (or other game piece) enters the cutout 204 of the goal box assembly 140 it may be returned to a player. In some embodiments, the player may simply reach into the goal box assembly 140 and manually retrieve the game piece. Typically however a ball return 224 will be provided to automatically return the ball to a player when a goal is scored.

FIGS. 3A-3C illustrate an exemplary ball return 224. FIG. 3A illustrates a top view of a ball return 224, while FIGS. 3B-3C respectively illustrate a side view and front view. In general, a ball return 224 has an opening 312 configured to receive a ball from a cutout of the goal box assembly. Once received, the ball is guided to a location at which it can be retrieved by a player. As can be seen, a ball return 224 may comprise a plurality of walls 308 that guide a ball received in the ball return. A ball return 224 also has a bottom 316, which may be sloped or angled to cause the ball to roll towards the location at which it can be retrieved, such as the exit 320 shown in FIGS. 3B-3C. FIG. 3D illustrates another exemplary ball return 224. As can be seen, the bottom 316 in this embodiments slopes downward towards a central portion of the ball return 224 where an exit 320 is located to allow a player to retrieve a ball.

As described above, players may utilize a paddle assembly to play the table game. In general, a paddle assembly will be used to strike or advance a ball (or other playing piece) during game play. Typically, a player's goal will be to advance a ball into an opposing players goal box assembly to score a point. Various paddle assemblies will now be described with regard to FIGS. 4A-4C.

FIGS. 4A-4B respectively illustrate a perspective and top view of a paddle assembly 404 secured to a playing surface 120 of the game table. As can be seen, the paddle assembly 404 may comprise a paddle or blade 416 from which one or more handles 412 may extend. In use, a player may manipulate the blade 416 via the handles 412, such as to move the blade laterally along the slot 124, swing the blade, or both. The blade 416 may have a rectangular shape, such as shown. It is contemplated that the blade 416 could alternatively be tapered at its distal ends or be formed in other shapes as well. Typically, the blade 416 will have a continuous structure from one end to another without openings or gaps.

FIG. 4C illustrates a side view of a paddle assembly 404 secured to a playing surface 120 of a game table. A ball 420 is also shown to illustrate how a blade 416 of the paddle assembly 404 may block, engage or strike a ball (or other game piece). As can be seen, the paddle assembly 404 will typically be slidably or movably secured to a playing surface 120. As shown in FIG. 4C for example, a fastener 424 extends through a slot 124 of the playing surface 120 to secure the paddle assembly 404. In this manner, the paddle assembly 404 is secured to the playing surface 120 while remaining movable along the length of the playing surface's slot 124. This permits lateral movement of the paddle assembly 404 by a player.

Referring briefly back to FIG. 1D, it can be seen that the side openings 108 in the side walls 132A, 132B of the game table 104 allow a distal portion of the paddle assembly's blade 416 to extend out of the game table when the paddle assembly is at either side of the game table. This increases the range of motion of the paddle assembly 404 as discussed above. In addition, since a side opening 108 may be elongated, rotation of the paddle assembly 404 is also not blocked by a sidewall 132A, 132B of the game table 104.

The paddle assembly 404 may include one or more bearings, sliders or pads 408A, 408B to reduce surface tension between the paddle assembly 404 and the playing surface 120. Referring to FIG. 4C for example, the fastener 424 secures a pair of pads 408A, 408B such that the playing surface 120 is therebetween. The fastener 424 is typically tightened such that the pads 408A, 408B are pressed to the playing surface. This helps ensure the paddle assembly 404 moves smoothly along the playing surface. It is contemplated that the fastener 424 may be tightened or loosened to respectively increase or decrease resistance to moving the paddle assembly 404. The fastener 424 may be various structures. For example, the fastener 424 may be a threaded fastener such as a screw or bolt that engages a corresponding threaded structure. Alternatively or in addition, the fastener 424 may be a rod or pin.

It is contemplated that one or more additional pads 428 may be included as well. Such additional pads 428 may be attached to the underside of the paddle 416, such as shown in FIG. 4C. A pad 408A, 408B, additional pad 428 or both may be wider than the slot 124 so as to prevent them from getting stuck or caught in the slot. In addition, in one or more embodiments, pads 408A, 408B, additional pads 428 or both may be tapered or rounded at their edges to help ease the movement of the paddle assembly 404 relative to the playing surface 120. It is also contemplated that a pad 408A, 408B, additional pad 428 or both may have a "T" shaped cross section such that a lower portion of the "T" shape may be received in the slot 124 when the paddle assembly 404 is installed.

A pad 408A, 408B will typically be constructed out of a low friction material, such as Teflon. The surface of a pad 408 may be smoothed or coated to reduce friction as well. For example, the surface of a pad 408A, 408B may have a Teflon, plastic or other friction-reducing coating at least where it engages a playing surface 120. The playing surface itself or portions thereof (such as those portions adjacent the slot 124) may be coated with one or more similar materials.

As can be seen from FIG. 4C, the fastener 424 forms a pivot point at which the paddle assembly 404 can be rotated while secured to the playing surface 120. This allows a player to swing the blade 416 of the paddle assembly 404 to strike a ball (or other game piece). It is contemplated that a plurality of fasteners 424 may be used in some embodiments. These fasteners 424 may be positioned linearly such as to provide a plurality of mounting points where the paddle assembly 404 is secured to the playing surface. In such case, the rotation of the paddle assembly will typically be limited or prevented altogether.

Figure 4D:
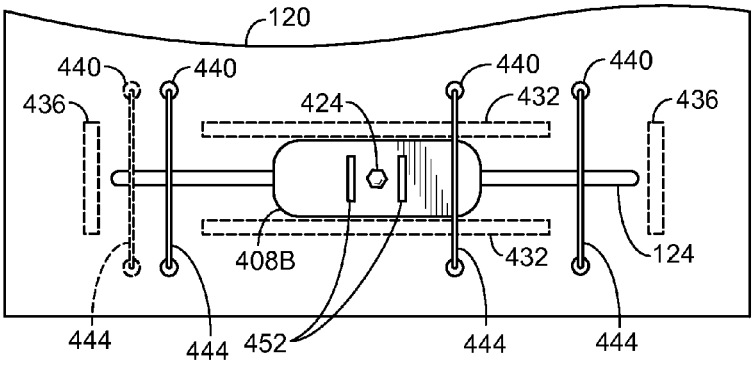
FIG. 4D is a bottom view of an exemplary paddle assembly.

FIG. 4D illustrates a bottom view of a paddle assembly 404 and playing surface 120. The bottom pad 408B of the paddle assembly 404 can be seen along with other elements of the game table beneath the playing surface 120. As can be seen, one or more elastic or resilient cords 444 may extend across the slot 124. As its name implies, a resilient cord 444 will typically be stretchable or elastic. For example, a resilient cord 444 may be a bungee cord in some embodiments.

A resilient cord 444 provides resistance to the movement of the paddle assembly 404. This is beneficial in that a resilient cord provides resistance as it is stretched thereby providing a workout or exercise to a player when the player moves the paddle assembly 404. As can be seen, one or more resilient cords 444 may be used. Resilient cords 444 may be added to increase resistance. For instance, as shown, two resilient cords are installed to the right of the paddle assembly 404 in FIG. 4D. In addition a resilient cord 444 can be positioned to cross the slot 124 at various locations. A resilient cord may be fastened or secured to the playing surface 120 via one or more mounts 440.

In operation, a resilient cord 444 will resist motion of the paddle assembly 404 once the paddle assembly contacts or engages the resilient cord. It is noted that a resilient cord 444 will typically also move the paddle assembly 404 as it contracts. It is contemplated that the paddle assembly 404 may optionally comprise one or more engagement blocks 452 configured to receive or engage one or more resilient cords 444 as the paddle assembly is moved. An engagement block 452 may be notched, concave, or have other shapes or structures configured to receive a resilient cord 444 as a paddle assembly 404 is moved. Alternatively or in addition, it is contemplated that a resilient cord 444 may be attached to the paddle assembly 404, such as at its pad 408B.

FIG. 4D also illustrates optional guides or guide blocks 432 that may be attached at the bottom of the playing surface 120. As can be seen, a guide block 432 may help define a path of motion for the paddle assembly 404 generally by preventing movement of the paddle assembly outside a predetermined path. In the embodiment of FIG. 4D, the guide blocks 432 define a linear path corresponding to the slot 124. It is noted that in embodiments where the slot 124 itself is sufficient to guide, guide blocks 432 will typically mot be provided.

One or more optional end blocks 436 are also shown in FIG. 4D. Similar to the guide blocks 432, an end block may prevent undesired motion of the paddle assembly 404. As shown in FIG. 4D for example, two end blocks 436 prevent the paddle assembly 404 from moving laterally beyond a certain point by physically blocking further lateral motion once the paddle assembly contacts one of the end blocks.

Figure 5:
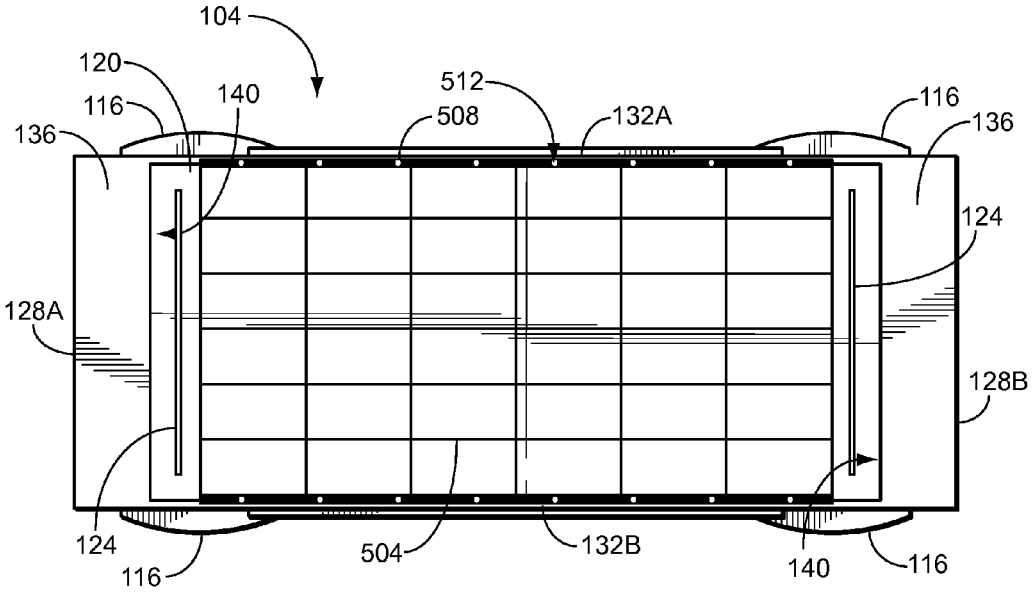
FIG. 5 is a top view of an exemplary net.

Referring to the top view of FIG. 5, it can be seen that the game table 104 may include a removable cover 504 to at least partially enclose the playing surface 120. A cover 504 may be used to prevent a ball (or other game piece) from exiting out of the top of the game table 104. This facilitates continuous game play. As can be seen from FIG. 5, the cover 504 may comprise a net and will typically have one or more attachment mounts 508 to secure the cover to the game table 104. As shown, the game table 104 may have corresponding mounts 512 for this purpose. To illustrate, a cover 504 may comprise mounts 508, such as one or more openings, that correspond to mounts 512 of the game table 104. In one or more embodiments, the mounts 512 of the game table may be threaded connectors such as a threaded opening, nut or the like that receive a threaded fastener such as a screw, bolt or the like.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A game table for exercise and recreation comprising:

a playing surface having a first end and a second end and two sides;

one or more first slots in the playing surface extending laterally between the two sides at the first end;

a first paddle assembly at a top side of the one or more first slots and comprising a first blade and one or more first handles;

one or more first pads at a bottom side of the one or more first slots, wherein the first paddle assembly is movably secured to the playing surface via one or more first fasteners extending from the first paddle assembly to the one or more first pads through the one or more first slots;

one or more second slots in the playing surface extending laterally between the two sides at the second end;

a second paddle assembly at a top side of the one or more second slots and comprising a second blade and one or more second handles;

one or more second pads at a bottom side of the one or more second slots, wherein the second paddle assembly is movably secured to the playing surface via one or more second fasteners extending from the second paddle assembly to the one or more second pads through the one or more second slots;

one or more first resilient cords attached to a bottom side of the playing surface, wherein the one or more first pads engage the one or more first resilient cords; and one or more second resilient cords attached to a bottom side of the playing surface, wherein the one or more second pads engage the one or more second resilient cords.

2. The game table of claim 1 further comprising a pair of end blocks at a bottom side of the playing surface.

3. The game table of claim 1 further comprising one or more guide blocks at a bottom side of the playing surface and extending parallel to the one or more first slots, the one or more second slots or both.

4. The game table of claim 1 further comprising a first goal box at the first end of the playing surface, and a second goal box at the second end of the playing surface.

5. The game table of claim 1 further comprising a cover enclosing the playing surface.

6. The game table of claim 1, wherein the playing surface is sloped.

7. A game table comprising:

a playing surface comprising a top side and a bottom side;

one or more first slots in the playing surface;

a first paddle at a top side of the one or more first slots and one or more first pads at a bottom side of the one or more first slots, wherein one or more fasteners extend from the first paddle to the one or more first pads through the one or more first slots; and one or more first resilient cords at the bottom side of the playing surface that engage the one or more first pads.

8. The game table of claim 7 further comprising a first goal box at a first end of the playing surface and a second goal box at a second end of the playing surface.

9. The game table of claim 7 further comprising one or more engagement blocks attached to the one or more first pads that engage the one or more first resilient cords.

10. The game table of claim 7 further comprising a pair of end blocks at a bottom side of the playing surface.

11. The game table of claim 7 further comprising one or more guide blocks at a bottom side of the playing surface and extending parallel to the one or more first slots.

12. The game table of claim 7 further comprising a cover enclosing the playing surface.

13. A game table comprising:

a playing surface comprising a top side and a bottom side;

one or more slots in the playing surface;

a paddle at each of the one or more slots, the paddle at the top side of the playing surface;

a pad at each of the one or more slots, the pad at the bottom side of the playing surface;

a member extending through each of the one or more slots, the member extending between the paddle and the pad at each of the one or more slots; and one or more resilient cords attached to the bottom side of the playing surface that engage the pad at each of the one or more slots.

* * * * *